US006589011B2

(12) United States Patent
Beeck et al.

(10) Patent No.: US 6,589,011 B2
(45) Date of Patent: Jul. 8, 2003

(54) DEVICE FOR COOLING A SHROUD OF A GAS TURBINE BLADE

(75) Inventors: Alexander Beeck, Orlando, FL (US); Reinhard Fried, Nussbaumen (CH); Markus Oehl, Waldshut-Tiengen (DE)

(73) Assignee: Alstom (Switzerland) Ltd, Baden (CH)

( * ) Notice: Subject to any disclaimer, the term of this patent is extended or adjusted under 35 U.S.C. 154(b) by 3 days.

(21) Appl. No.: 09/996,693

(22) Filed: Nov. 30, 2001

(65) Prior Publication Data

US 2002/0136635 A1 Sep. 26, 2002

(30) Foreign Application Priority Data

Dec. 16, 2000 (DE) ..... 100 62 907

(51) Int. Cl.[7] ..... F04D 31/00

(52) U.S. Cl. ..... 415/116; 415/175; 415/115; 62/165

(58) Field of Search ..... 62/165; 415/175, 415/116

(56) References Cited

U.S. PATENT DOCUMENTS 3,756,020 A * 9/1973 Moskowitz et al. ..... 60/39.66
3,781,129 A * 12/1973 Aspinwall ..... 416/97
4,086,757 A * 5/1978 Karstensen et al. .... 60/39.16 R
4,162,136 A * 7/1979 Parkes ..... 416/97 R
4,712,979 A 12/1987 Finger
4,752,184 A * 6/1988 Liang ..... 415/116
5,743,708 A * 4/1998 Cunha et al. ..... 415/115
5,967,743 A * 10/1999 Meylan ..... 415/115
6,179,555 B1 * 1/2001 Tremaine ..... 415/115
6,179,557 B1 * 1/2001 Dodd et al. ..... 415/115
2002/0018715 A1 * 2/2002 Dailey ..... 416/1

* cited by examiner

*Primary Examiner*—William C. Doerrler
*Assistant Examiner*—Mark Shulman
(74) *Attorney, Agent, or Firm*—Burns, Doane, Swecker & Mathis, L.L.P.

(57) ABSTRACT

Described is a cooling device for a shroud of a gas turbine blade, having a cooling channel system provided in the shroud, which is provided radially to the gas turbine blade with cooling channels that are open on one side, and which is closed off with a cover plate. The invention is characterized in that, between the cover plate and the cooling channels that are open on one side, an impact cooling plate is provided in such a way that the impact cooling plate rests on the cooling channels that are open on one side, is pressed against them by force, and encloses a space with the cover plate.

9 Claims, 2 Drawing Sheets

DEVICE FOR COOLING A SHROUD OF A GAS TURBINE BLADE

FIELD OF THE INVENTION

The invention relates to a cooling device for a shroud of a gas turbine blade, having a cooling system inside the shroud, which cooling system has, radially to the gas turbine blade, cooling channels that are open on one side, and which is closed off with a cover plate.

BACKGROUND OF THE INVENTION

Because of the high combustion temperatures in powerful, modern gas turbine systems, the gas turbine components exposed directly or indirectly to the hot gases created during the combustion process are cooled actively. In particular, the gas turbine blades directly exposed to the hot gases are provided with internal cooling channels, through which the cooling air is guided radially from the blade root through the blade hub in the direction of the blade shroud in order to cool, if possible, all areas of a gas turbine blade effectively from the inside. The efficiency of such cooling measures plays a decisive role for the maximum thermal stressability and, ultimately, the maximum life span of a gas turbine blade. Since the cooling air is fed into the cooling channel system from the sides of the blade root, the cooling effect of the cooling air is reduced as a result of the increasing heating in the radial direction towards the blade tip or the shroud area. However, those areas of a turbine blade extending radially are subject to the greatest thermal and, in particular, mechanical loads, especially rotating blades, which are subject, because of their rotation, to significant centrifugal forces.

A gas turbine blade provided with a shroud or outer platform is provided for cooling purposes inside the shroud with a hollow channel system that comprises superficial structures deflecting the cooling air flow in order to distribute and guide the cooling air. For manufacturing reasons of a gas turbine blade that can be produced by way of a casting process, the shroud area provided with the flow channels is constructed radially open on one side. With the help of a cover plate, the flow area for the cooling air is closed off inside the shroud by joining the cover plate flush with the radially oriented topside of the shroud. In general, this is achieved by high-temperature soldering. Such a joint connection between a shroud 1 and a cover plate 2 is shown in a partial cross-section illustration according to FIG. 2. The cover plate 2 is joined in a fixed manner by way of a high-temperature soldering joint 3 with the circumferential edge of the shroud 1. The cooling channels 4 that are constructed radially open on one side and are limited by the cooling air guide surfaces 5 are closed off radially in a gas-tight manner by the cover plate 2. The partial cross-section illustration according to FIG. 2 does not show the inflow and outflow cooling channels oriented radially inside the turbine blade, through which cooling air is fed into and discharged from the shroud area, whereby the cooling air in the cooling channels 4 cools the turbine blade tip. As already mentioned in the beginning, the cooling air flowing through the shroud area is only able to cool with a relatively low efficiency because of the heating present in the radial direction in the gas turbine blade, so that measures must be sought through which the cooling effect can be increased especially in the shroud area by way of the cooling air.

SUMMARY OF THE INVENTION

The invention is based on the objective of further developing, with respect to an improved cooling effect, a cooling device for a shroud of a gas turbine blade with a cooling channel system provided in the shroud, said cooling channel system having, radially to the gas turbine blade, cooling channels that are open on one side, and which is closed off with a cover plate, so that the thermally and mechanically greatly stressed shroud area of a gas turbine blade can be better cooled. The measures to be implemented should require very little additional constructive and technical expenditure, but at the same time may cause a clearly better cooling effect than is the case for the shroud cooling measures known so far.

According to the invention, a cooling device is further developed in such a way that an impact cooling plate is provided between the cover plate and the cooling channels that are open on one side in such a way that the impact cooling plate rests on the cooling channels that are open on one side, is pressed against them by force, and encloses a space with the cover plate.

By providing an impact air cooling plate in the flow path of the cooling channel system in the cover plate, cooling air passes through narrowed flow openings inside the impact air cooling plate, so that the cooling air is locally accelerated and, in the form of an impact air cooling jet, impacts a cooling channel wall that is located opposite from the passage opening in the flow direction of the inside of the impact air cooling plate. As a result of the accelerating effect of the impact air cooling plate on the cooling air flow, the heat transfer coefficient between the gas turbine blade and the cooling air flow is locally increased, and the cooling effect of the cooling air flow is improved.

By providing a distance between the impact cooling plate and the cover plate, it is possible to feed a cooling air flow by way of forced guidance through a corresponding cooling channel into the space enclosed between cover plate and impact cooling plate, so that the cooling air, as a result of the overpressure occurring in the space, forces the cooling air to pass through the plurality of flow openings provided in the impact cooling plate. On the other hand, the cooling airflow is able to flow by way of an alternative, suitable cooling channel arrangement also through the impact cooling plate in opposite direction, so that the cover plate is acted on with impact air in a targeted manner.

In order to ensure, on the one hand, an, if possible, gas-tight resting of the impact cooling plate on the shroud's cooling channel system that is constructed as open on one side, and, on the other hand, to ensure a positioning of the impact cooling plate, if possible, free of bending tensions between the cover plate and the shroud, the impact cooling plate is pressed by force against the cooling channels that are open on one side. The pressing is done with the help of at least one spacer element, which is constructed so as to be preferably elastically or plastically deformable and is provided between the cover plate and impact cooling plate, preferably in the edge area of the impact cooling plate.

The cover plate itself, as already mentioned initially, is joined in a fixed manner with the shroud using standard joining techniques, for example high-temperature soldering, whereby the combustor pulsations generate the pressing force onto the impact cooling plate necessary for the force-derived connection. In order to avoid high pressing forces and to ensure the possibility of a largely free thermal expansion for the impact cooling plate, the spacer element is constructed so as to be elastically or plastically deformable, so that in the case of exceeding a maximum permissible joining force between the cover plate and the impact cooling plate, a deformation of the spacer element occurs.

In a simplest embodiment, the impact cooling plate is joined only along its circumferential edge between the cover plate and shroud with the help of the aforementioned spacer element, which is constructed in the form of a sealing lip extending near the circumferential edge of the impact cooling plate. In order to avoid possible superficial warping within the impact cooling plate, either additional spacer elements can be placed between the cover plate and impact cooling plate, or the impact cooling plate should be constructed with correspondingly designed elevations and/or recesses that come into contact with the cover plate and/or the shroud, and which fixate the impact cooling plate by force yet without tension.

In order to avoid cooling air leaks at those points where the impact cooling plate is pressed by force against the shroud or, on the other side, against the cover plate, additional sealing elements are used, each of which can be positioned between the impact cooling plate and the shroud or cover plate.

A spring-like element can furthermore be used advantageously to press the impact cooling plate by way of the surface of the cover plate against the shroud's cooling system that is constructed as open on one side. This gives the impact cooling plate a surface pressing effect with respect to the shroud, so that the impact cooling plate can be pressed in an almost gas-tight manner against the structure of the cooling channels.

BRIEF DESCRIPTION OF THE DRAWINGS

The invention is described below as an example, using exemplary embodiments in reference to the drawings without limiting the general idea of the invention. Hereby.

DETAILED DESCRIPTION OF THE PREFERRED EMBODIMENTS

Figure 1:
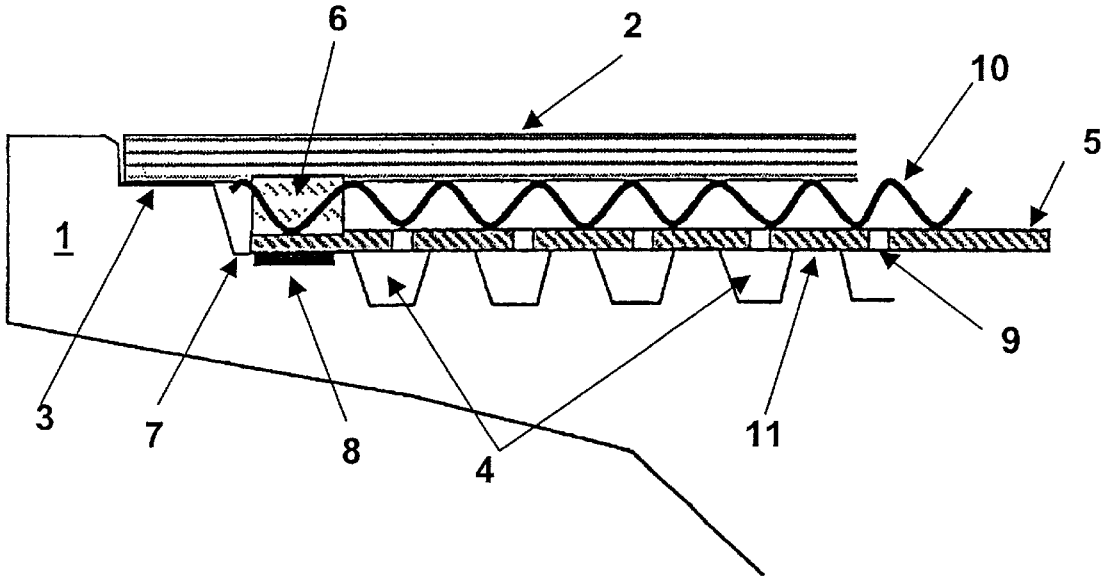
FIG. 1 shows a partial cross-section view through a shroud with impact cooling plate.
Figure 2:
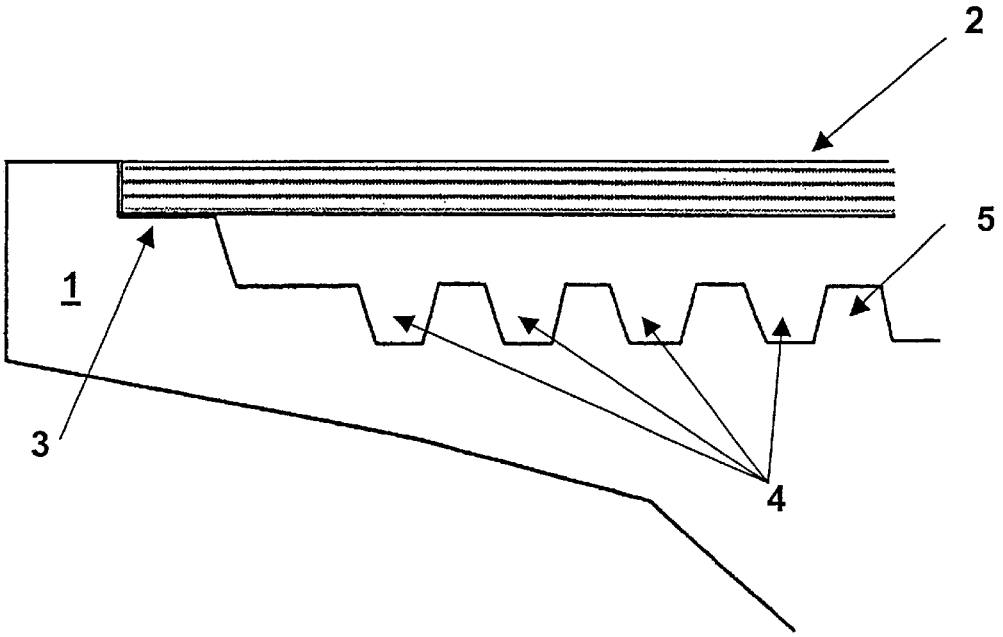
FIG. 2 shows a partial cross-section view through a known shroud (state of the art)

FIG. 1 is a schematic illustration of a partial cross-section view through the shroud 1 of a turbine blade. Radially, the shroud 1 is joined with a cover plate 2, preferably by way of a high-temperature soldering connection 3. Between the cover plate 2 and the shroud 1, a cooling channel system 4 is provided, which is covered by an impact cooling plate 5. The impact cooling plate 5 is pressed by force between the cover plate 2 and the shroud 1 by means of a spacer piece 6. In the shown exemplary embodiment, the spacer element 6 extends over the entire circumferential area of the impact cooling plate 5 and presses the impact cooling plate 5 with a joining force that is adjustable via the cover plate 2 against the support surface 7 on the shroud 1. In the contact area in the support surface 7, a sealing element 8 is also provided, which on the one hand is used for a gas-tight termination and, on the other hand, for an improved clamping effect, in particular transversely to the pressing force.

The impact cooling plate 5 has flow passage openings 9 with a narrowed flow cross-section, through which cooling air passes, depending on the pressure conditions, from the cooling channels 4 in the direction of the cover plate 2 or, in the reverse direction, in the form of a local impact cooling plate, and in this way results in an improved cooling effect.

For the purposes of a superficial stabilization of the impact cooling plate 5, a spring-like, gas-permeable element 10 is preferably provided, which additionally presses the impact cooling plate against the cooling channel wall structures 11 in a gas-tight manner.

The joining force with which the impact cooling plate 5 is joined by force between the cover plate 2 and the shroud 1 preferably should be limited so that at least the impact cooling plate 5 is kept free of bending tensions in the path of its thermal expansion. For this purpose, the spacer element 6 is manufactured from an elastically or plastically deformable material, so that the spacer element 6 is elastically deformed when a maximum joining force is exceeded, so that an exceeding of the joining force onto the impact cooling plate 5 is not further transferred.

Figure 3:
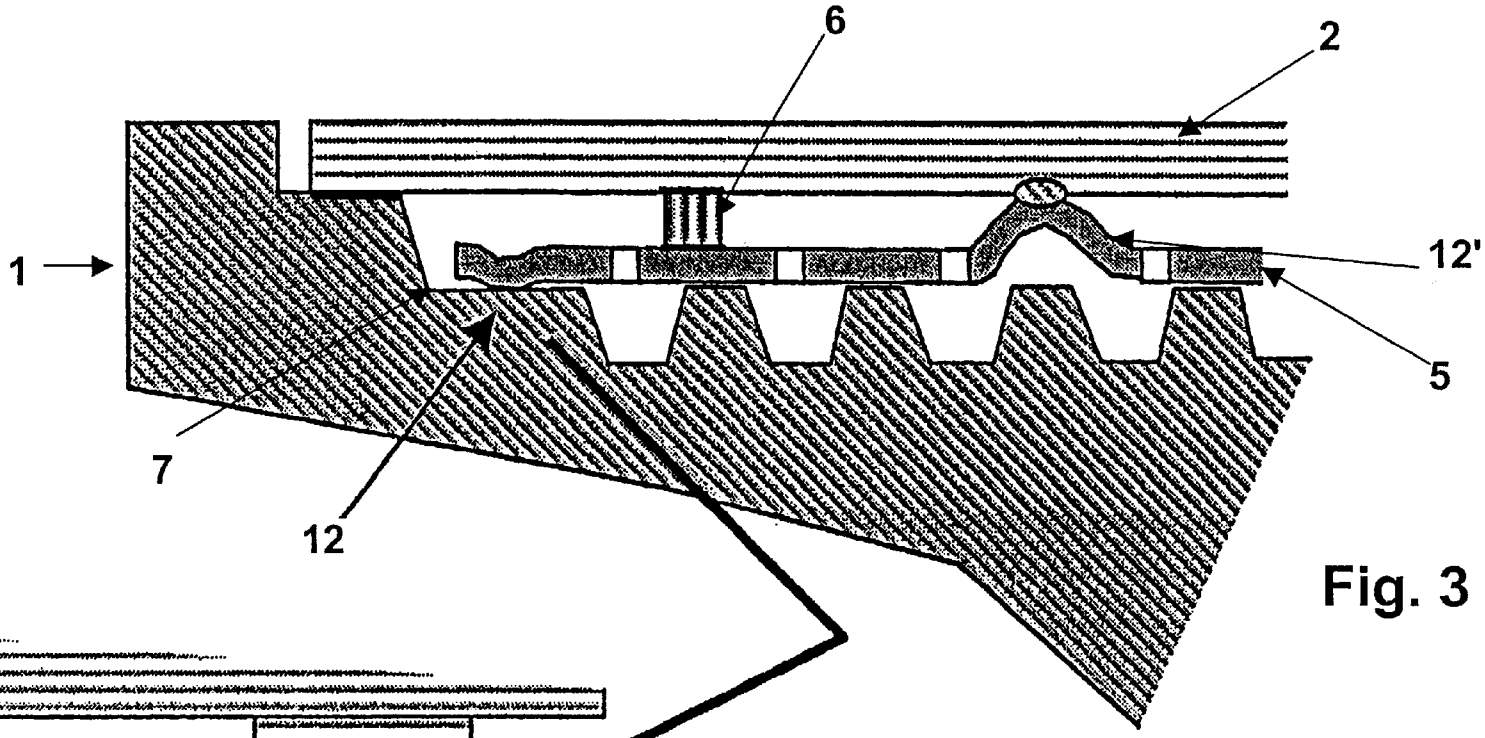
FIG. 3 shows a partial cross-section view through a shroud with an impact cooling plate having elevations and recesses.

FIG. 3 shows a comparable partial cross-section view analogous to FIG. 1; however, the impact cooling plate 5 has bead-like deformations 12. The impact cooling plate 5 rests via a bead 12 constructed as a recess extending along the circumferential edge of the impact cooling plate on the support surface 7 of the shroud 1. In addition, by providing a sealing surface (not shown) in the area of the support surface of the bead 12, a gas-tight termination can be ensured between the impact cooling plate 5 and the shroud 1. In the center of the impact cooling plate 5, a bead 12' constructed as an elevation is provided, where said bead contacts the underside of the cover plate 2 and thus presses the impact cooling plate 5 centrally against the cooling channels of the shroud 1. Additional spacer elements 6, of which only one is shown in FIG. 3, can be used to further fixate the impact cooling plate 5.

Figure 4:
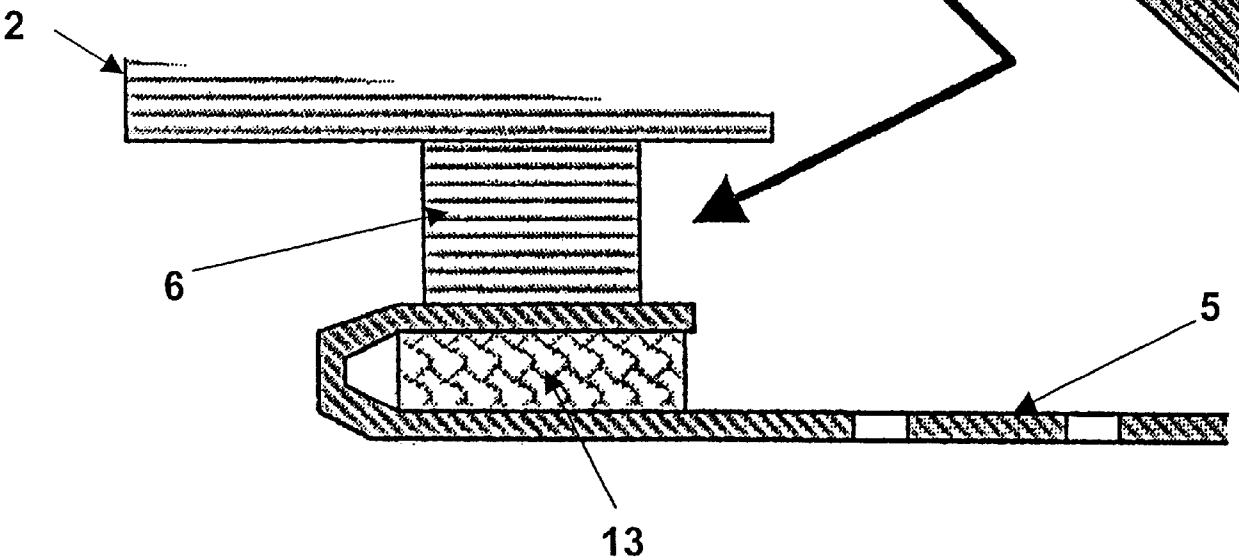
FIG. 4 shows a detailed view of a pressing connection between a cover plate and an impact cooling plate.

FIG. 4 shows a detail view of a pressing connection between a cover plate 2 and the impact cooling plate 5. The edge area of the impact cooling plate 5 is hereby constructed in a beaded manner and has an elastic spacer element 13 in the beaded area. The previously described spacer element 6 is again placed between the cover plate 2 and the impact cooling plate 5.

What is claimed is:

1. Cooling device for a shroud of a gas turbine blade, having a cooling channel system provided in the shroud, which is provided radially to the gas turbine blade on one side with open cooling channels, and which is closed off with a cover plate, wherein between the cover plate and the cooling channels that are open on one side, an impact cooling plate is provided in such a way that the impact cooling plate rests on the cooling channels that are open on one side, is pressed against them by force, and encloses a space with the cover plate.

2. Cooling device according to claim 1, wherein between the cover plate and impact cooling plate, at least one spacer element is provided in such a way that the impact cooling plate can be pressed by means of the joining force present between the cover plate and the shroud elastically, plastically limited against the cooling channels that are open on one side.

3. Cooling device according to claim 2, wherein the spacer element can be elastically or plastically deformed.

4. Cooling device according to claim 1, wherein the impact cooling plate has elevations and/or recesses that come into contact with the cover plate and/or the shroud and fixate the impact cooling plate in a force-derived yet tension-free manner.

5. Cooling device according to claim 4, wherein the recess is constructed in the form of a bead extending in the area of the circumferential edge of the impact cooling plate, said bead resting on a support surface on the shroud, which support surface surrounds the cooling channels that are open on one side.

6. Cooling device according to claim 5, wherein a sealing element is provided in the area of the support surface on the shroud, through which sealing element the impact cooling plate is in contact with the shroud.

7. Cooling device according to claim 1, wherein the spacer element presses the impact cooling plate in the area of its circumferential edge against the shroud.

8. Cooling device according to claim 1, wherein in the space an elastic, gas-permeable element is provided which presses the impact cooling plate by force against the cooling channels that are open on one side.

9. Cooling device according to claim 8, wherein the elastic, gas-permeable element is a spring element.

* * * * *